US006333967B1

(12) United States Patent
Osaka et al.

(10) Patent No.: US 6,333,967 B1
(45) **Date of Patent: *Dec. 25, 2001**

(54) X-RAY GENERATOR

(75) Inventors: Naohisa Osaka, Ome; Seiichi Hayashi, Mito, both of (JP)

(73) Assignee: Rigaku Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/405,219

(22) Filed: Sep. 27, 1999

Related U.S. Application Data

(63) Continuation-in-part of application No. 08/896,463, filed on Jul. 18, 1997, now abandoned.

(30) Foreign Application Priority Data

Jul. 19, 1996 (JP) ..... 8-190704

(51) Int. Cl.[7] ..... H01J 35/00
(52) U.S. Cl. ..... 378/121
(58) Field of Search ..... 378/121–144

(56) References Cited

U.S. PATENT DOCUMENTS

| | | | |
|---|---|---|---|
| 2,677,069 | 4/1954 | Bachman . | |
| 3,018,398 | 1/1962 | Atlee . | |
| 3,549,931 | 12/1970 | DeLucia . | |
| 4,433,431 | 2/1984 | Pfeiler . | |
| 4,693,933 | 9/1987 | Keen et al. . | |
| 4,979,199 * | 12/1990 | Cueman et al. | 378/138 |

FOREIGN PATENT DOCUMENTS 7-504491 5/1995 (JP) .
WO-92/08235 5/1992 (WO) .

OTHER PUBLICATIONS

Cosslett et al., "X–Ray Microscopy", Cambridge at the Univ. Press, 1960, pp. 105–109.
Flugge, Encyclopedia of Physics, vol. XXX Springerverlage Berlin, Heidelberg 1957, pp. 324,325.
Schuster et al., "Parallel–Beam Coupling into Channel–Cut Monochromators using Curved Granded Multilayers", J. Phys. D: Appln. Phys. 28 (1995) pp. A270–A275, Printed in the UK.
Gutman et al., "Comment, Calculation of Improvement to HRXRD System through–put using Curved Graded Multilayers", J. Phys. D: Appln. Phys., 29 (1996) pp. 1675–1676, Printed in UK.
Schuster et al., "Reply to Comment, Culculation of Improvements to HRXRD System through–put Curved Graded Multilayers", J. Phys. D: Appl. Phys. 29 (1996) pp. 1677–1679, Printed in the UK.

* cited by examiner

*Primary Examiner*—Craig E. Church
(74) *Attorney, Agent, or Firm*—Armstrong, Westerman, Hattori, McLeland & Naughton, LLP

(57) ABSTRACT

An X-ray generator includes a hermetically sealed main generator unit, and an electron gun and a target housed inside the main generator unit, and bombards the target with electrons emitted from the electron gun and passes an X-ray beam emitted from the surface of the target owing to the bombardment to the exterior through an exit window. An X-ray optical element is provided inside the main generator unit on the output path of the X-ray beam emitted from the target for regulating the X-ray beam and the X-ray beam regulated by the X-ray optical element is passed through the exit window. This configuration improves the durability of the X-ray optical element and enables the length of the X-ray path to the X-ray irradiation point to be shortened so as to suppress attenuation of the emitted X-ray beam by air resistance and thereby reduce power consumption.

26 Claims, 6 Drawing Sheets

X-RAY GENERATOR

This application is a continuation-in-part of prior application Ser. No. 08/896,463 filed Jul. 18, 1997 now abandoned.

BACKGROUND OF THE INVENTION

1. Field of the Invention

This invention relates to an X-ray generator usable as the X-ray source of an X-ray diffraction apparatus or the like, more particularly to an X-ray generator in which an X-ray beam emitted from the surface of a target bombarded with electrons is regulated beforehand within the main generator unit before passage to the exterior through an exit window.

2. Description of the Related Art

The prior-art X-ray generator produces an X-ray beam by bombarding a target with electrons emitted from an electron gun (cathode). The X-ray beam emitted from the surface of the target passes to the exterior through an exit window provided in a wall of the main generator unit.

The X-ray beam emitted from this type of X-ray generator is ordinarily regulated using an X-ray optical element to obtain a parallel beam, condensed beam, spectral or split beam or other beam with beam characteristics appropriate for the intended use.

FIG. 6 shows an example of the system layout of an X-ray diffraction apparatus utilizing this kind of X-ray generator as the X-ray source.

The X-ray diffraction apparatus has a sample base 3, a divergence slit 4, a receiving slit 5 and an X-ray detector 6 mounted on a goniometer 2. X-ray diffraction analysis is effected by directing an X-ray beam emitted from an X-ray generator 1 onto a sample S attached to the sample base 3.

An X-ray optical element 7 is provided in the path of the X-ray beam emitted from the X-ray generator 1 at a position upstream of the divergence slit 4. The X-ray optical element 7 condenses the X-ray beam emitted from the X-ray generator 1 and directs the condensed X-ray beam onto the surface of the sample S.

The peak intensities of the diffracted X-rays produced by the irradiation of the sample S with the X-ray beam appear at diffraction angles dependent on the crystal structure etc. of the sample surface. These peak intensities are detected by the X-ray detector 6. The diffraction angles ($2\theta$) at which the peak intensities appear are measured by the goniometer and used to analyze the sample crystal structure and the like.

The conventional X-ray generator described in the foregoing is only capable of producing an X-ray beam by bombarding a target with electrons from an electron gun and emitting the generated X-ray beam through an exit window. It is not capable of regulating the X-ray beam generated from the surface of the target.

Such regulation has therefore required an X-ray optical element to be disposed in the open air as a separate unit from the X-ray generator.

Since the X-ray optical element disposed in the air is susceptible to contamination by moisture, dust and the like contained in the air, its X-ray beam regulation performance rapidly deteriorates.

In addition, the X-ray beam encounters resistance from air molecules. The X-ray intensity therefore attenuates with increasing length of the X-ray beam path between the window of the X-ray generator and the point of irradiation (the surface of the sample on the X-ray diffraction apparatus). In the conventional mode of use, since the X-ray optical element has to be disposed in the air between the X-ray generator and the irradiation point, the length of the X-ray path is increased at least by the size of the X-ray optical element. Wasteful attenuation of the X-ray intensity is therefore unavoidable.

Since this requires a high-intensity X-ray beam to be generated from the target in order to make up for air attenuation, it causes a proportional increase in power consumption. It is therefore uneconomical from the point of operating cost.

SUMMARY OF THE INVENTION

This invention was accomplished to overcome these problems of this type of X-ray generator and the X-ray optical element used therewith and aims to provide an X-ray generator which, by incorporation of an X-ray optical element therein, improves the durability o the X-ray optical element and also enables the length of the X-ray path to the X-ray irradiation point to be shortened so as to suppress attenuation of the emitted X-ray beam by air resistance and thereby reduce power consumption.

The invention achieves this object by providing an X-ray generator which includes an electron gun and a target housed inside a hermetically sealed main generator housing which defines a main generator unit, bombards the target with electrons emitted from the electron gun and passes an X-ray beam emitted from a surface of the target owing to the bombardment to the exterior of the main generator unit through an exit window, the X-ray generator comprising at least one X-ray optical element provided inside the main generator unit on an output path of an X-ray beam emitted from the target for regulating the X-ray beam, the X-ray beam regulated by the X-ray optical element being passed to the exterior through the exit window.

Since the interior of the main generator unit is a hermetically sealed space, degradation of the X-ray optical element by moisture, dust and the like is suppressed. The X-ray beam emitted from the surface of the target is passed to the exterior through the exit window after being regulated by the X-ray optical element provided inside the main generator unit. The X-ray beam is therefore already converted into a parallel beam, condensed beam, spectral or split beam, or other beam state suitable for the purpose before exiting through the window. Since this makes it unnecessary to dispose an X-ray optical element in the open air, the length of the X-ray path between the exit window of the X-ray generator and the irradiation point can be shortened to the minimum required. The attenuation of the X-ray intensity in the air is therefore reduced and the power consumption required for X-ray generation decreases accordingly.

Since the target and the X-ray optical element are incorporated in the main generator unit, they can be located close to each other. Therefore, it is possible to enlarge a capture angle of an X-ray beam, emitted from the target, to the X-ray optical element.

By enlarging the capture angle as described above, a large amount of the X-ray emitted from the target can be captured into the X-ray optical element, whereby an amount of X-ray passed to the exterior through the exit window is increased. Therefore, the X-ray can be efficiently utilized.

Accordingly, the present invention with the above structure arrangement can accomplish not only a reduction of power consumption required for X-ray generation but a size reduction of the electron gun and the target. Further, since the reduction of the power consumption results in a decrease of heat value from the target, the circulating water for cooling the target can be saved. When the target is employed as a rotary target, the target can be driven at a low rotational speed, whereby vibrations caused by the rotation are remarkably lowered.

Further, even when the target with simple structure is employed as a fixed target, a large amount of the X-ray emitted from the target can be captured into the X-ray optical element. Thereby, it is possible to exit a sufficient amount of X-ray.

As explained above, the present invention can accomplish the effects in which power consumption is reduced, and the target for emitting a X-ray and others are simplified in structure and reduced in size, thereby bringing the satisfactory performance at low cost. Therefore, there are advantages to the users in using the present invention.

The optical element is selected among dispersive and reflective structures for regulating the X-ray beam emitted by the generator. For example, the optical element is a reflector having a reflective face of appropriate shape to regulate the X-ray beam as desired, for example a parabolic or cylindrical reflective surface or mirror, or a combination, for example, by assembly or juxtaposition, of such reflectors or mirrors to reflect and diverge the X-ray beam. Examples of such optical elements are given in U.S. Pat. No. 4,693,933 issued Sep. 15, 1987 in the form of multilayer Bragg reflectors used as condenser for unparallel or parallel beam or for ellipsoidal beam, and coupled multi-reflective microchromators and mirrors.

In a preferred embodiment, each optical element is mounted in the generator unit by a mount which is separate and independent from the mount of the target and the mount of the electron gun.

The reflection on the reflective X-ray optical element is not limited to a reflection on the surface of the optical element. For example, in the case where the optical element has a multi-layer structure, X-rays are reflected not only at the surface of the optical element but also at each layer thereof. Generally, the reflective element performs a function of reducing the divergence of the X-ray beam by reflection. This function of reducing the divergence of the X-ray beam includes, for example, converting the X-ray beam into parallel beam, condensed beam, or spectral or split beam.

The exit window is preferably provided near the X-ray optical element because the area of the window then has to be only large enough to pass the X-ray beam of low divergence issuing from the X-ray optical element. When the window area is small, even a relatively thin exit window exhibits sufficient pressure resistance to enable operation in a vacuum state. Since the thickness of the exit window can therefore be reduced, attenuation of the X-ray beam by absorption loss during transmission through the exit window can be reduced.

A configuration can be adopted wherein the interior of the main generator unit is formed with at least one compartment divided off from the space accommodating the target by a partition for shutting out at least recoil electrons and X-rays, the partition is formed with an X-ray passage hole for passing an X-ray beam emitted from the surface of the target, the X-ray optical element is disposed inside the compartment, and the exit window is formed in a wall of the compartment.

Inside the main generator unit, particularly in the vicinity of the electron bombarded surface of the target, electrons projected from the electron gun and colliding with the target recoil from the target surface and scatter into the surrounding region as recoil electrons. These recoil electrons have various deleterious effects. Most notably, they accelerate degeneration of the X-ray optical element and the exit window when they impinge thereon.

When the X-ray optical element is provided in the compartment divided off by a partition and the exit window is formed in a wall of the compartment as described above, the partition protects the X-ray optical element and the exit window by shutting out the recoil electrons.

The X-ray generator configured in the foregoing manner is preferably provided with shutter means operable from the exterior for opening and closing the X-ray passage hole. By closing this shutter means to shut the X-ray passage hole when the X-ray generator is in standby mode (in which no X-ray beam is emitted to the outside), the X-ray beam and the small number of recoil electrons that normally leak through the X-ray passage hole can be prevented from impinging on the X-ray optical element to further suppress element degradation.

The X-ray generator of the invention can be configured such that the main generator unit includes an X-ray generator housing containing or equipped with at least the electron gun and the target to form an X-ray generator block and an X-ray optical element block containing or equipped with at least the X-ray optical element to form an X-ray optical element block and such that the X-ray optical element block is a separate unit detachable from the X-ray generator block.

Constituting the X-ray optical block as a separate unit in this manner enables the X-ray optical element to be incorporated into the main generator unit when needed. Since this makes it possible to provide an X-ray generator with specifications adaptable to a broad range of user use modes, it expands the utility of the X-ray generator.

Further, the main generator unit of the X-ray generator of this invention can be formed with an access window for attaching and exchanging the X-ray optical element and be provided with a detachable cover for opening and closing the access window. This arrangement enables X-ray optical elements to be attached and exchange with ease and also facilitates maintenance and management of the X-ray optical element.

As pointed out earlier, the electrons projected from the electron gun and colliding with the target recoil from the target surface and scatter into the surrounding region within the main generator unit as recoil electrons. Since the invention disposes the X-ray optical element in this environment, the importance of preventing degradation of the X-ray optical element by the recoil electrons is high.

The X-ray generator of this invention is therefore preferably provided inside the main generator unit with anti-recoil electron protector means for preventing bombardment of the X-ray optical element by recoil electrons. The anti-recoil electron protector means can, for instance, comprise a metal member enclosing the output path of the X-ray beam generated by the target and having the same electric potential as the electron gun.

When a metal member having the same electrical potential as the electron gun is provided to enclose the output path of the X-ray beam, a repulsive force arises between the metal member and the recoil electrons advancing toward the X-ray optical element by along the same path as the X-ray beam. This repulsive force diverts the recoil electrons from this path.

The anti-recoil electron protector means can also be constituted as a metal member enclosing the X-ray optical element and having the same electric potential as the electron gun. This effectively prevents recoil electrons from hitting the X-ray optical element since the recoil electrons on a collision course with the X-ray optical element have their path altered by the repulsive force arising between the recoil electrons and the metal member.

The X-ray optical element is heated by the incident X-ray beam. Since the invention disposes the X-ray optical element in the restricted space within the main generator unit, the importance of protecting the X-ray optical element from generated heat is high. It is therefore preferable in this invention to attach the X-ray optical element to a mount provided with cooling means.

Further, to enable the X-ray optical element to function effectively, the X-ray generator is preferably provided with adjustment means enabling positional and angular adjustment of the element relative to the path of the incident X-ray beam to be effected from outside the main generator unit.

The X-ray optical element incorporated into the X-ray generator of this invention can be any of various elements capable of converting an incident X-ray beam into a parallel beam, condensed beam, spectral or split beam, or other beam state suitable for the purpose at hand. The X-ray optical element adopted must, however, be of a size that can be installed inside the main generator unit.

X-ray optical elements of this description include, for example, the focusing multilayer mirror. The focusing multilayer mirror is a multilayer elliptic cylinder mirror consisting of a silicon substrate whose surface is shaped like the inner surface of an elliptic cylinder and is overlaid with alternate layers of a heavy element such as W (tungsten) and a light element such as Si (silicon). This multilayer can condense X-rays into a linear beam.

As the X-ray optical element of this invention, there can also be used one, such as taught by Published Japanese translations of PCT international publication No. 7-504491, which passes a tube of flux to convert X-rays into a parallel beam, condensed beam or a spectral or split beam.

Since, as explained in the foregoing, the X-ray generator of this invention internally incorporates at least one X-ray optical element, it can emit an X-ray beam regulated to the desired state. Since it therefore does not require an externally disposed X-ray optical element, it enables the length of the X-ray path to the X-ray irradiation point to be shortened so as to suppress attenuation of the emitted X-ray beam by air resistance.

Moreover, incorporation of the X-ray optical element inside the main generator unit suppresses degradation of the element and improves its durability.

The above and other objects, features and advantages of the invention will be apparent from the following detailed description which is to be read in conjunction with the accompanying drawings.

DETAILED DESCRIPTION OF THE PREFERRED EMBODIMENT

An embodiment of the invention will now be explained with reference to the drawings.

Figure 1:
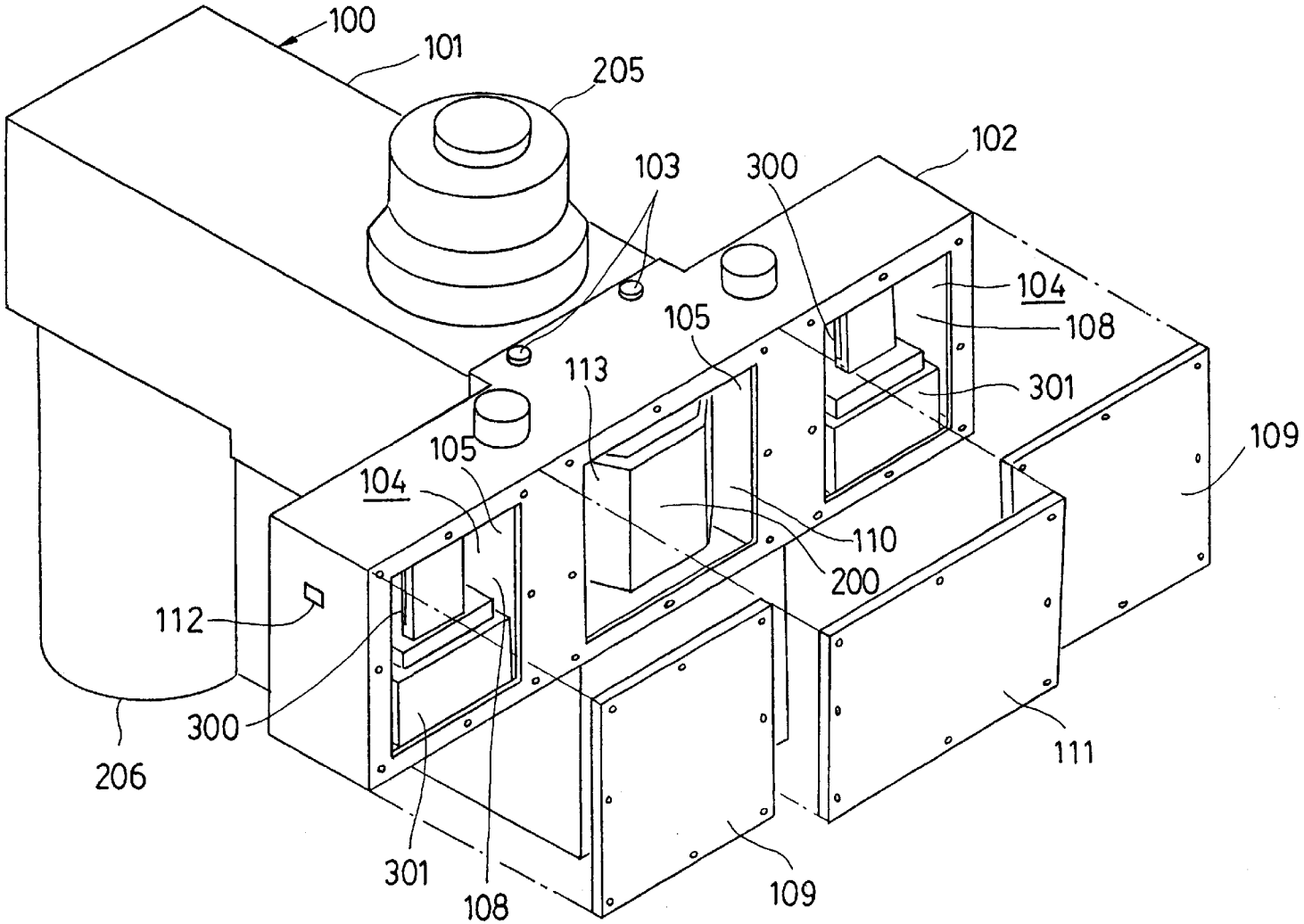
FIG. 1 is a perspective, partially exploded view showing the exterior of an X-ray generator which is an embodiment of the invention.
Figure 2:
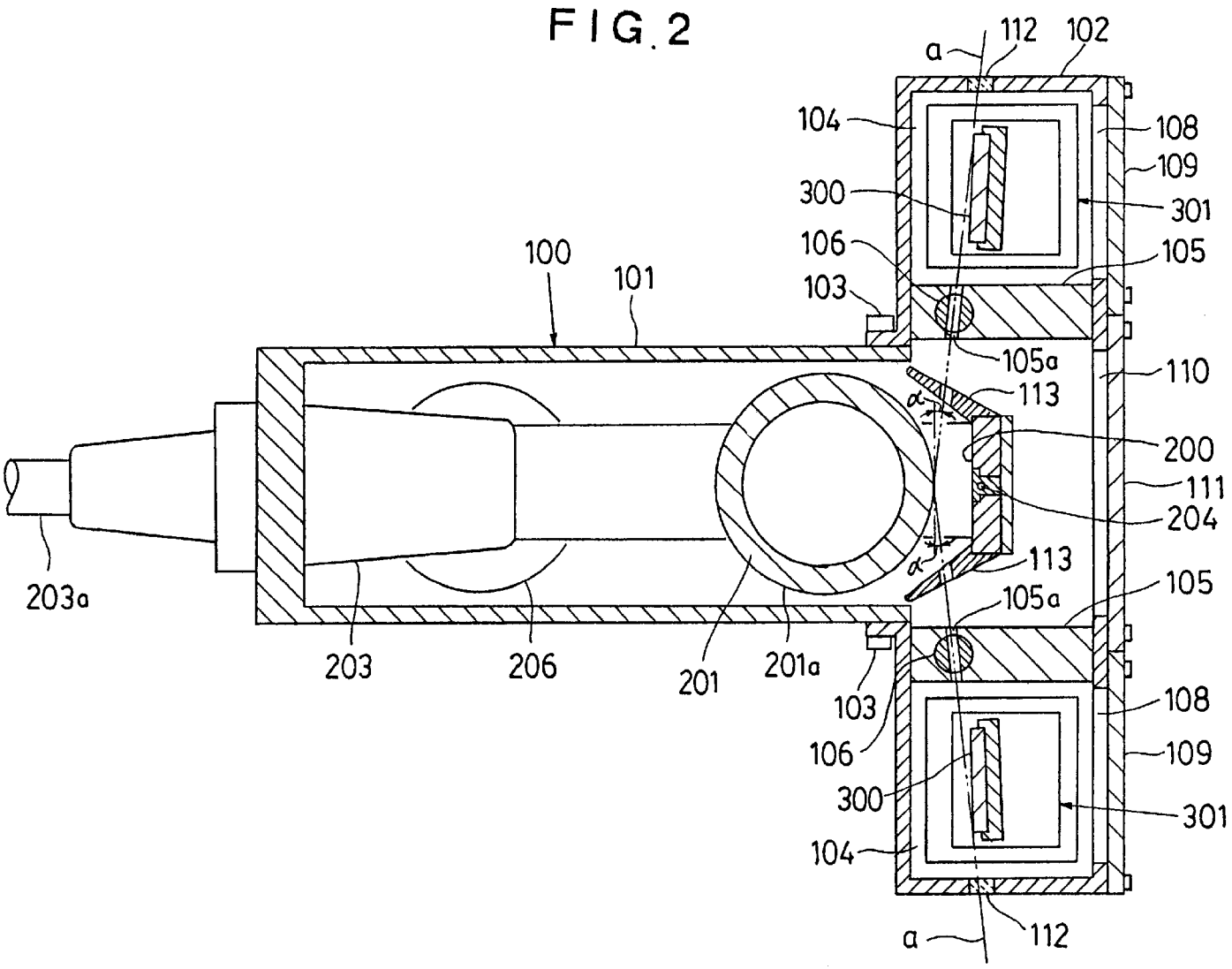
FIG. 2 is a plan view of the same generator.
Figure 3:
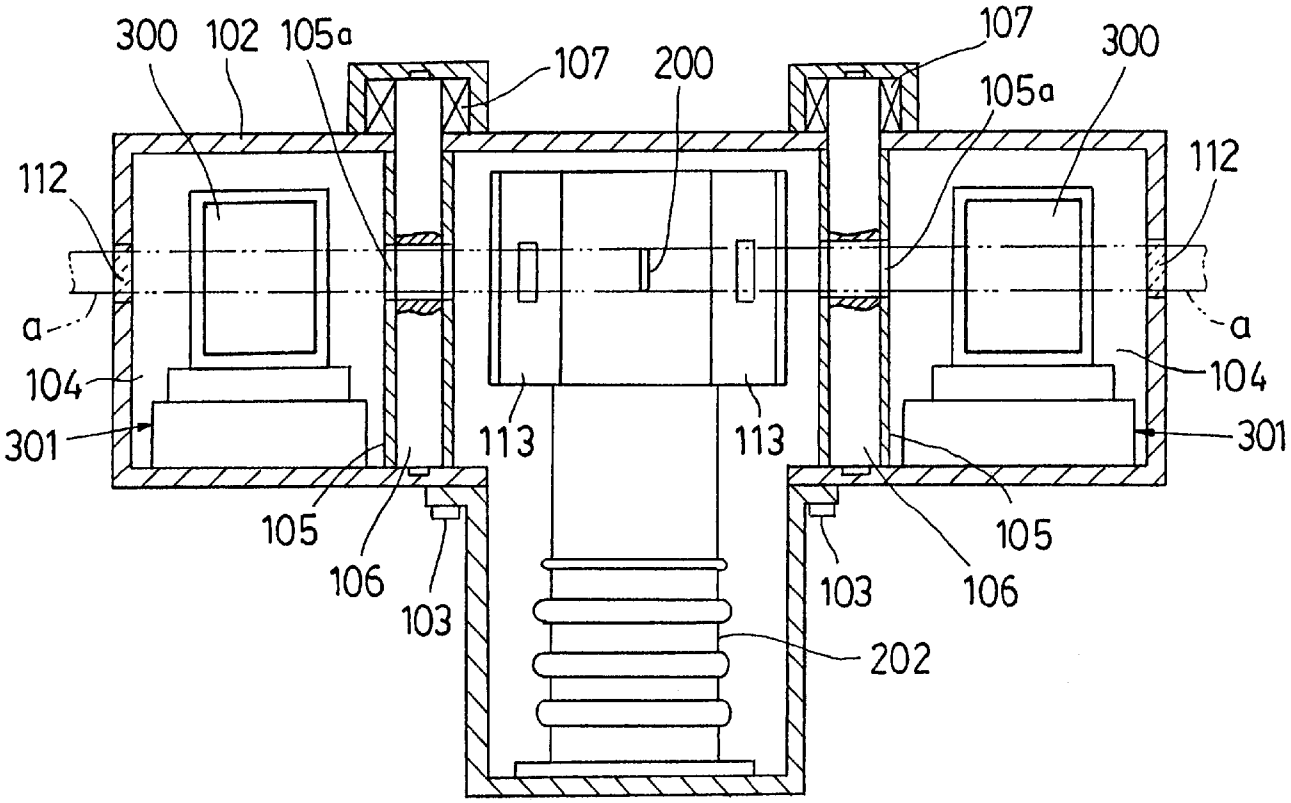
FIG. 3 is a side sectional view from the left in FIG. 2 of the X-ray optical block of the same generator.

FIG. 1 is a perspective, partially exploded view showing the exterior of an X-ray generator which is an embodiment of the invention, FIG. 2 is a plan view of the same generator, and FIG. 3 is a side sectional view from the left in FIG. 2 of the X-ray optical block of the same generator.

As shown in these drawings, this embodiment of the X-ray generator has an electron gun (cathode) 200, a target (a rotary target) 201 which is rotatable and X-ray optical elements 300, 300 housed in a main generator unit 100.

The main generator unit 100 is divided into an X-ray generator block 101 equipped with constituent elements required for X-ray generation and an X-ray optical element block 102 equipped with constituent elements required for regulating the generated X-rays. The X-ray optical element block 102 is a separate unit detachable from the X-ray generator block 101. The main generator unit 100 is constituted by attaching the X-ray optical element block 102 to the X-ray generator block 101 by fastening members (e.g. bolts) 103. The X-ray generator block 101 and the X-ray optical element block 102 are preferably joined via a packing or other such seal member (not shown) to ensure hermetic sealing.

The electron gun 200 and the target 201 are installed in the X-ray generator block 101. The electron gun 200 is mounted on a pedestal 202 made of insulator so as to protrude into the middle of the X-ray optical element block 102. A high-voltage lead-in tube 203 for connecting a high-voltage cable 203*a* is provided at the rear end portion of the X-ray generator block 101. High-voltage supplied through the high-voltage lead-in tube 203 is applied between a filament 204 of the electron gun 200 and the target 201.

The electron gun 200 is structured to focus electrons emitted by the filament 204 toward the target 201.

As shown in FIG. 2, the target 201 is disposed to face the electron gun 200. It is adapted to be rapidly rotated by a drive motor 205 which, as shown in FIG. 1, is mounted on an outer wall of the X-ray generator block 101. The peripheral surface of the target 201 is constituted of a target surface 201*a* made of copper foil or the like. The target surface 201*a* generates X-rays when bombarded by electrons (hot electrons) emitted by the electron gun 200.

It is generally known that when the target 201 is bombarded with electrons in the direction normal to its embodiment, X-ray optical elements 300, 300 are disposed on the output paths a of the X-ray beams derived at angles $\alpha$=6–10° relative to the tangent to the target 201.

The bombarding electrons generate heat in the target 201. The target 201 is therefore cooled by operating a coolant pump (not shown) to pump a coolant through an internal circulation passage (not shown) formed inside the target 201.

The X-ray generator block 101 is equipped with a vacuum pump 206 for evacuating the interior of the main generator unit 100.

The interior of the X-ray optical element block 102 is partitioned to form compartments 104, 104 for housing the X-ray optical elements 300, 300 at locations on the output paths a of the X-rays from the target 201. Each compartment 104 is divided off from the space accommodating the target 201 by a partition 105. The partitions 105, 105 are formed as metal members or the like with shielding property against X-rays and recoil electrons.

In order to establish the same vacuum ambience in the compartments 104, 104 as in the X-ray generator block 101, the partitions 105, 105 are formed with holes (not shown) communicating with the X-ray generator block 101.

In order to establish the same vacuum ambience in the compartments 104, 104 as in the X-ray generator block 101, the partitions 105, 105 are formed with holes (not shown) communicating with the X-ray generator block 101. The communication holes are formed at locations least likely to allow passage of recoil electrons.

Each partition 105 is formed with an X-ray passage hole 105*a* so that the output path a of the X-ray beams generated at the target 201 can pass unobstructed. Each partition 105 is also fitted with a rotary shutter 106 for opening and closing the X-ray passage hole 105*a*. The shutters 106, 106 are driven to rotate by solenoids 107, 107 or other such drive means. Like the partitions 105, 105, the shutters 106, 106 are also made of a material with shielding property against X-rays and recoil electrons. They are closed when the X-ray beams generated by the target 201 must not be released to the exterior, such as when the X-ray generator is in stand-by mode.

Each compartment 104 is equipped with a mount 301 for the X-ray optical element 300.

Figure 4:
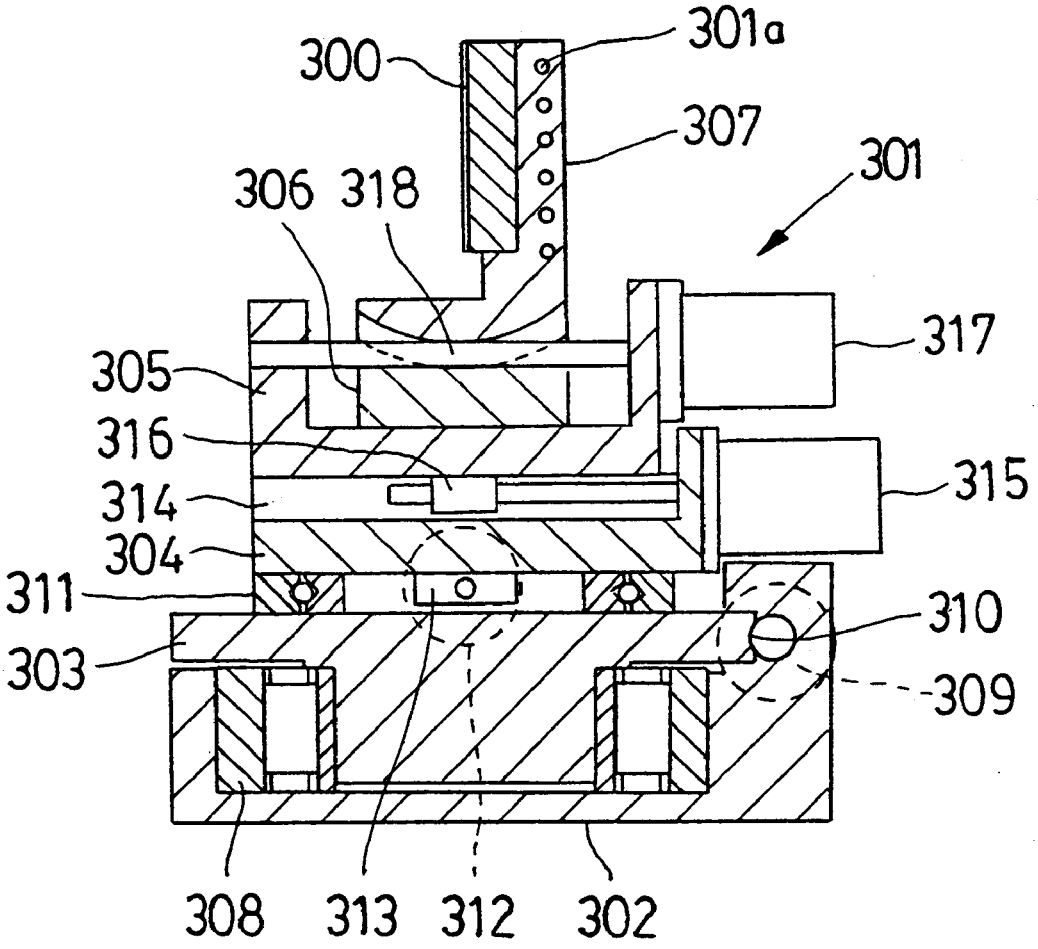
FIG. 4 is a sectional view showing the structure of a mount built into the same generator.

FIG. 4 is a sectional view showing the structure of the mount 301. As shown, the mount 301 comprises a base 302, a turntable 303, a Y-table 304 movable in the Y direction, an X-table 305 movable in the X direction, a swinging table 306 and an element holder 307. The mount 301 comprising these members is arranged to enable adjustment of the position and angle of the X-ray optical element 300 attached to the element holder 307.

Specifically, the turntable 303 is rotatably mounted on the base 302 through a roller bearing 308 and can be rotated about its center axis by a worm mechanism 310 driven by a motor 309. The Y-table 304 is mounted on the turntable 303 through Y-sliders 311 extending laterally (in the Y direction) and can be moved along the Y-slider 311 by a ball screw mechanism 313 driven by a motor 312.

The X-table 305 is mounted on the Y-table 304 via X-sliders 314 extending in the longitudinal direction (X direction) and can be moved along the X-sliders 314 by a ball screw mechanism 316 driven by a motor 315. The swinging table 306 is mounted on the X-table 305. The rotational output of a motor 317 is transmitted to the element holder 307 through a worm mechanism 318 to oscillate (swing) the element holder 307 in the longitudinal direction.

Since the X-ray optical element 300 is mounted on the front surface of the element holder 307, it can be rotated, moved in the X and Y directions and swung in the longitudinal direction by the operation of these tables to adjust its position and angle with respect to an X-ray beam entering from the target 201.

The motors 309, 312, 315 and 317 are controlled by an external controller (not shown) to enable the operation of adjusting the X-ray optical element 300 to be conducted from outside the X-ray generator.

The element holder 307 is also formed with a coolant circulation passage (cooling means) 301*a*. The X-ray optical element 300 mounted on the element holder 307 is cooled by operating a circulation pump (not shown) to pump a coolant through the circulation passage 301*a*. By this, the X-ray optical element 300 can be effectively cooled to suppress degradation thereof owing to the heat produced by the incident X-ray beam.

In addition, as shown in the figures, the mount 301 is separate and independent from the target and can be adjusted independently from the target. In particular, the mount 301 the optical element 300 does not move or rotate with the target when the target is rotated.

As shown in FIG. 1, the front of the X-ray optical element block 102 is formed with access windows 108, 108 at positions opposite the mounts 301, 301. These access windows 108, 108 are used for mounting the X-ray optical elements 300, 300 on the element holders 307, 307 or exchanging previously mounted X-ray optical elements 300, 300 with others. The access windows 108, 108 are normally covered with covers 109, 109 attached by screws or other fastening members.

The front of the X-ray optical element block 102 is also formed with an access window 110 at a position opposite the electron gun 200. The access window 110 is used for attaching or exchanging the filament 204 of the electron gun 200. The access window 110 is normally covered with a cover 111.

The walls forming the compartments 104, 104 of the X-ray optical element block 102 are formed with exit windows 112, 112 for the X-ray beams. Each exit window 112 is located near the associated X-ray optical element 300 to enable the X-ray beam regulated by the X-ray optical element 300 to pass to the exterior. The X-ray beams passing through the exit windows 112, 112 have been suppressed in divergence beforehand by the X-ray optical elements 300, 300. Passage of the X-ray beams is therefore sufficient even if the exit windows 112, 112 are made relatively small in area. Windows of small area also advantageous from the point that adequate window strength can be secured even when the window thickness is reduced. The exit windows 112, 112 are made of beryllium or other material exhibiting low X-ray absorption.

As shown in FIG. 2, anti-recoil electron protector plates 113, 113 are disposed to enclose parts of the output paths a of the X-ray beams generated by the target 201. The anti-recoil electron protector plates 113, 113 are plates formed of metal and electrically connected to the electron gun 200 to have the same electric potential as the electron gun 200. The anti-recoil electron protector plates 113, 113 can be formed integrally with the electron gun 200.

Most of the electrons which scatter as recoil electrons after colliding with the target 201 are prevented from invading the compartments 104, 104 by the partitions 105, 105, but those that pass along the output paths a and fly into the X-ray passage holes 105*a*, 105*a* in the partitions 105, 105 cannot be shut out. The anti-recoil electron protector plates 113, 113 of the same electric potential as the electron gun 200 are therefore provided to enclose the output paths a so as to deflect the recoil electrons from the output paths a.

In the X-ray generator of the foregoing configuration, X-ray beams are emitted from the surface of the target 201 when the target 201 is bombarded with electrons projected from the electron gun 200. These X-ray beams pass, through the X-ray passage holes 105*a*, 105*a* in the partitions 105, 105, enter the compartments 104, 104, impinge on the X-ray optical elements 300, 300 mounted in the compartments 104, 104 to be converted into parallel beams, condensed beams, spectral or split beams, or other beam state suitable for the purpose, and are emitted to the exterior through the exit windows 112, 112. Since the X-ray beams are regulated into a state suitable for the purpose inside the X-ray generator in this way, no need arises to dispose an X-ray optical element 300 in the open air. The length of the X-ray path between each exit window 112 of the X-ray generator and the irradiation point can therefore be shortened to the minimum required. The attenuation of the X-ray intensity in the air is therefore reduced and the power consumption required for X-ray generation decreases accordingly.

Figure 5:
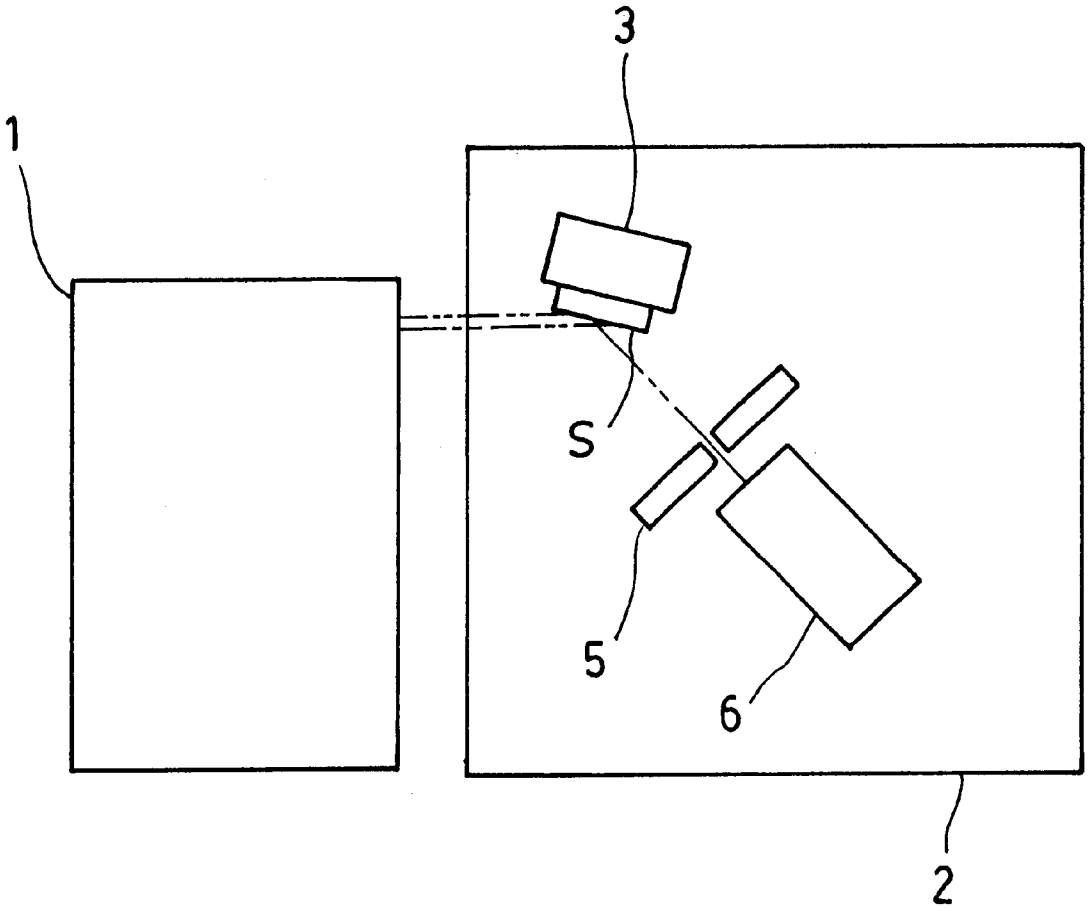
FIG. 5 is a schematic diagram showing an example of the system layout of an X-ray diffraction apparatus utilizing an X-ray generator according to this invention as the X-ray source.
Figure 6:
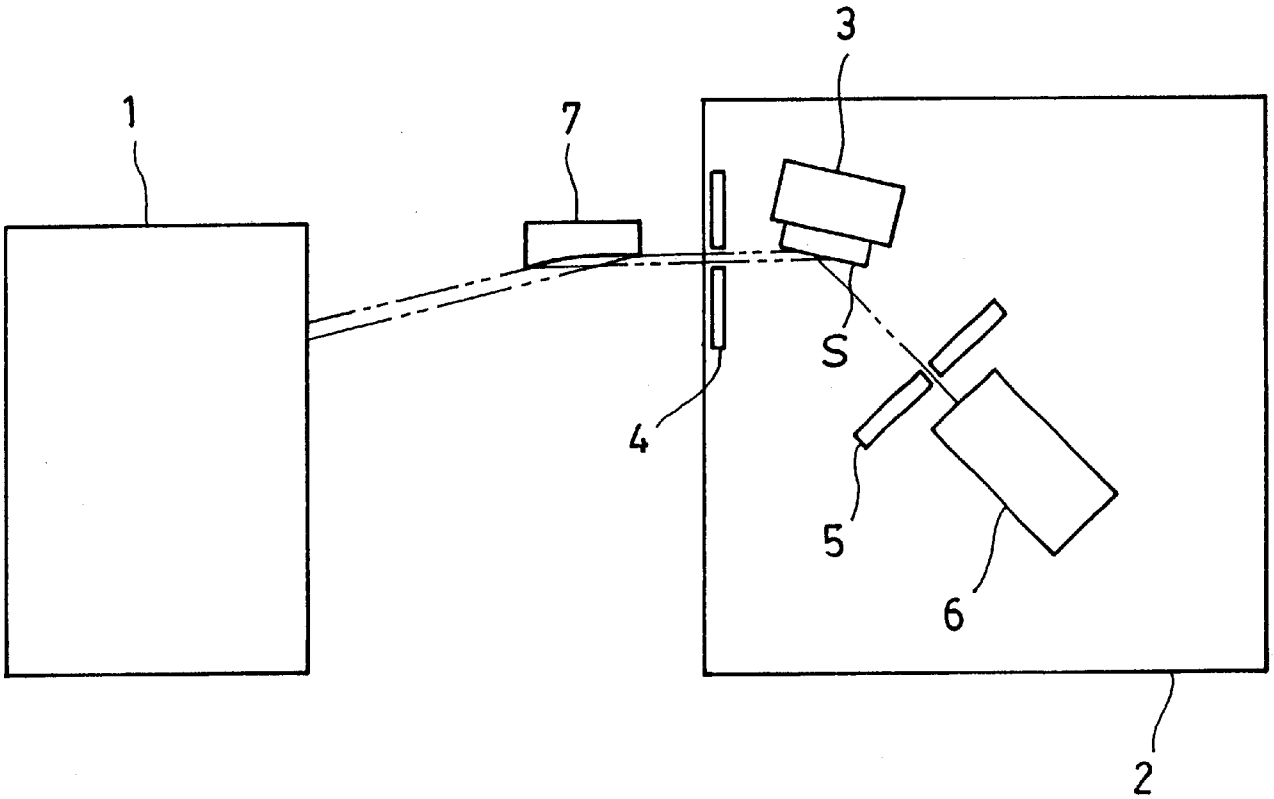
FIG. 6 PRIOR ART
FIG. 6 is a schematic diagram showing an example of the system layout of an X-ray diffraction apparatus utilizing a prior-art X-ray generator as the X-ray source.

FIG. 5 shows an example of the system layout of an X-ray diffraction apparatus utilizing an X-ray generator according to this invention as the X-ray source. As shown in this figure, since no X-ray optical element needs to be installed between the invention X-ray generator 1 and the sample S, i.e., the point to be irradiated with X-rays, the X-ray generator 1 and the sample S can be positioned close together to reduce loss of X-ray beam intensity owing to air resistance in the open air.

The invention is not limited to the aforesaid embodiment. Appropriate design modifications are of course possible as regards such aspects of the constituent elements as their specific configurations, materials, structures and the like.

In accordance with necessity, anti-recoil electron protector means made of metal members having the same electric potential as the electron gun 200 can be installed around the X-ray optical elements 300, 300 to suppress impingement of recoil electrons on the X-ray optical elements 300, 300 by the repulsive force arising between the metal members and the recoil electrons. For example, the element holders 307, 307 of the foregoing embodiment can be formed of metal members and be made to function as anti-recoils electron protector means by electrically connecting them to the electron gun 200.

What is claimed is:

1. An X-ray generator comprising:

a hermetically sealed main generator unit;

an electron gun and a target housed inside the hermetically sealed main generator unit, wherein the electron gun bombards the target with electrons; and at least one X-ray optical element, provided inside the main generator unit on an output path of an X-ray beam emitted from the target, for regulating the X-ray beam, wherein the X-ray beam is regulated by the X-ray optical element being passed to the exterior of the main generator unit through an exit window;

wherein said at least one X-ray optical element is a reflective structure which diverges said X-ray-beam prior to said X-ray beam passing through said exit window.

2. An X-ray generator according to claim 1, wherein the exit window is located near the X-ray optical element.

3. An X-ray generator according to claim 1, wherein the interior of the main generator unit is formed with at least one compartment divided off from the space accommodating the target by a partition for shutting out at least recoil electrons and X-rays, the partition is formed with an X-ray passage hole for passing an X-ray beam emitted from the surface of the target, the X-ray optical element is disposed inside the compartment, and the exit window is formed in a wall of the compartment.

4. An X-ray generator according to claim 3, further comprising shutter means operable from the exterior for opening and closing the X-ray passage hole.

5. An X-ray generator according to claim 1, wherein the main generator unit includes an X-ray generator block equipped with at least the electron gun and the target and an X-ray optical element block equipped with at least the X-ray optical element, the X-ray optical element block being a separate unit detachable from the X-ray generator block.

6. An X-ray generator according to claim 1, wherein the main generator unit is formed with at least one access window for attaching and exchanging the X-ray optical element and is provided with at least one detachable cover for opening and closing the access window.

7. An X-ray generator according to claim 1, wherein the interior of the main generator unit is formed with at least one anti-recoil electron protector means for preventing bombardment of the X-ray optical element by recoil electrons.

8. An X-ray generator according to claim 7, wherein the anti-recoil electron protector means comprises a metal member enclosing the output path of an X-ray beam generated by the target and having the same electric potential as the electron gun.

9. An X-ray generator according to claim 7, wherein the anti-recoil electron protector means comprises a metal member enclosing the X-ray optical element and having the same electric potential as the electron gun.

10. An X-ray generator according to claim 1, wherein the X-ray optical element is attached to a mount provided with cooling means.

11. An X-ray generator according to claim 1, further comprising adjustment means enabling positional and angular adjustment of the X-ray optical element relative to the path of an incident X-ray beam to be effected from outside the main generator unit.

12. An X-ray generator according to claim 1, wherein the X-ray optical element is mounted in the hermetically sealed main generator unit by a mount which is separate and independent from the target.

13. An X-ray generator according to claim 1, wherein the optical element is a reflector having a reflector face.

14. An X-ray generator according to claim 13, wherein the reflective face is parabolic.

15. An X-ray generator according to claim 13, wherein the reflective face is cylindrical.

16. An X-ray generator according to claim 1, wherein the optical element is a combination of reflectors each having a reflective face.

17. An X-ray generator comprising:

a hermetically sealed main generator unit including an X-ray generator block equipped with at least an electron gun and a target, and an X-ray optical element block equipped with at least one X-ray optical element, the X-ray optical element block being a separate unit detachable from the X-ray generator block;

wherein the electron gun bombards the target with electrons;

the at least one X-ray optical element is located on an output path of an X-ray beam emitted from the target, for regulating the X-ray beam, wherein the X-ray beam is regulated by the X-ray optical element being passed to the exterior of the main generator unit through an exit window; and said at least one X-ray optical element is a reflective structure which diverges said X-ray beam prior to said X-ray beam passing through said exit window.

18. An X-ray generator according to claim 17, wherein the ext window is located near the X-ray optical element.

19. An X-ray generator according to claim 17, wherein the interior of the main generator unit is formed with at least one component divided off from the space accomodating the target by a partition for shutting out at least recoil electrons and X-rays, the partition is formed with an X-ray passage hole for passing an X-ray beam emitted form the surface of the target, the X-ray optical element is disposed inside the compartment, and the exit window is formed in a wall of the compartment.

20. An X-ray generator according to claim 17, wherein the main generator unit is formed with at least one access window for attaching and exchanging the X-ray optical element and is provided with at least one detachable cover for opening and closing the access window.

21. An X-ray generator according to claim 17, further comprising adjustment means enabling positional and angular adjustment of the X-ray optical element relative to the path of an incident X-ray beam to be effected from outside the main generator unit.

22. An X-ray generator according to claim 17, wherein the X-ray optical element is mounted in the hermetically sealed main generator unit by a mount which is seperate and independent from the target.

23. An X-ray generator according to claim 17, wherein the optical element is a reflector having a reflector face.

24. An X-ray generator according to claim 23, wherein the reflective face is parabolic.

25. An X-ray generator according to claim 23, wherein the reflective face is cylindrical.

26. An X-ray generator according to claim 17, wherein the optical element is a combination of reflectors each having a reflective face.

* * * * *